US011787019B2

(12) United States Patent
Chiang

(10) Patent No.: US 11,787,019 B2
(45) Date of Patent: Oct. 17, 2023

(54) WRENCH AND METHOD FOR MANUFACTURING THE SAME

(71) Applicant: William Tools Co., Ltd., Taichung (TW)

(72) Inventor: Shui-Lai Chiang, Taichung (TW)

(73) Assignee: WILLIAM TOOLS CO., LTD., Taichung (TW)

( * ) Notice: Subject to any disclaimer, the term of this patent is extended or adjusted under 35 U.S.C. 154(b) by 0 days.

(21) Appl. No.: 17/585,918

(22) Filed: Jan. 27, 2022

(65) Prior Publication Data

US 2022/0314405 A1 Oct. 6, 2022

(30) Foreign Application Priority Data

Mar. 31, 2021 (TW) ..... 110111900

(51) Int. Cl.
*B25B 23/00* (2006.01)
*B25B 13/46* (2006.01)
*B25B 13/10* (2006.01)

(52) U.S. Cl.
CPC ..... *B25B 23/0035* (2013.01); *B25B 13/107* (2013.01); *B25B 13/46* (2013.01)

(58) Field of Classification Search
CPC ... B25B 23/0035; B25B 13/107; B25B 13/46; B25B 13/06; B25B 23/0007
USPC ..... 81/58, 6, 124
See application file for complete search history.

(56) References Cited

U.S. PATENT DOCUMENTS 6,125,722 A * 10/2000 Hopper, Jr. ..... B25B 13/463 81/62
6,918,323 B2 * 7/2005 Arnold ..... B25B 13/463 81/63
7,353,735 B2 * 4/2008 Patel ..... B25B 13/463 81/62
7,954,402 B2 * 6/2011 Crawford ..... B25B 23/0035 81/177.85
8,109,180 B2 * 2/2012 Hu ..... B25B 13/463 81/60
8,297,152 B2 * 10/2012 Hu ..... B25B 13/463 81/63.1
8,342,059 B2 * 1/2013 Hu ..... B25B 13/463 81/60
8,806,986 B2 * 8/2014 Chen ..... B25B 13/463 81/62
10,807,217 B2 * 10/2020 Ross ..... B25B 23/0007
2017/0066167 A1 * 3/2017 Lambert ..... B29C 45/14836

* cited by examiner

*Primary Examiner* — Don M Anderson
*Assistant Examiner* — Jason Khalil Hawkins
(74) *Attorney, Agent, or Firm* — Muncy, Geissler, Olds & Lowe

(57) ABSTRACT

A wrench and a method for manufacturing the same are provided. The wrench includes a main body and a covering member. The main body includes a head portion and a handle. The head portion has a receiving groove. The covering member covers the receiving groove. One of the main body and the covering member has a first washer and a second washer integrally disposed thereon. The first washer and the second washer are abutted against and between the main body and the covering member. Therefore, shapes of the first washer and the second washer are designable and can be directly formed on any position of the wrench.

8 Claims, 9 Drawing Sheets

WRENCH AND METHOD FOR MANUFACTURING THE SAME

BACKGROUND OF THE INVENTION

Field of the Invention

The present invention relates to a wrench and a method for manufacturing the same.

Description of the Prior Art

A hand tool, such as a ratchet wrench or a torque wrench, capable of adjusting rotational angle and torque setting value is usually used to tighten or loosen fasteners. In assembling the hand tool, an interior of a main body of the hand tool is filled with lubricating oil after assembling a ratchet member and a ratchet tooth therewithin so that a driving member of the hand tool is smoothly rotated. An opening of the interior of the main body is covered with a cover, and a sealing ring is disposed between the cover and the main body so as to prevent the ratchet member and the ratchet tooth from being damaged due to dust or impurities.

However, during operation, the sealing ring is easy to displace relative to the main body and the cover, which results in poor sealing effect and is easy to pollute the interior of the main body.

The opening may be sealed with glue filled between the cover and the main body. However, since the glue may be squeezed to deform by the cover and the main body before curing, a shape of the glue cannot be effectively controlled, which is also results in poor sealing effect.

The present invention is, therefore, arisen to obviate or at least mitigate the above-mentioned disadvantages.

SUMMARY OF THE INVENTION

The main object of the present invention is to provide a wrench and a method for manufacturing the same, wherein the wrench includes a covering member on which a first washer and a second washer are integrally formed. Therefore, the first washer and the second washer can be accurately positioned on the main body during assembling, and the first washer and the second washer respectively have a fixed shape. In addition, shapes of the first washer and the second washer are designable and the first washer and the second washer can be formed on designated positions of the covering member by transfer molding according to structural requirements, which provides good sealing effect and allows diverse designs of the wrench.

To achieve the above and other objects, the present invention provides a wrench, including: a main body and a covering member. The main body includes a head portion and a handle, and the head portion has a receiving groove. The receiving groove has a driving member and a restriction member disposed therewithin, the restriction member is abutted against the driving member, and the driving member is rotatable relative to the head portion. The covering member covers the receiving groove and includes a through hole. One of the main body and the covering member has a first washer and a second washer integrally disposed thereon, and the first washer and the second washer are abutted against and between the main body and the covering member.

To achieve the above and other objects, the present invention further provides a method for manufacturing the wrench as described above, including following steps of:

preparing a main body including a head portion and a handle; forming a receiving groove on a side of the head portion; rotatably assembling a driving member within the receiving groove; assembling a restriction member within the receiving groove and abutting the restriction member against the driving member; preparing a covering member; forming a through hole on the covering member; integrally forming a first washer and a second washer on one of the main body and the covering member by transfer molding; covering the receiving groove of the head portion with the covering member; and abutting the first washer and the second washer against and between the main body and the covering member.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
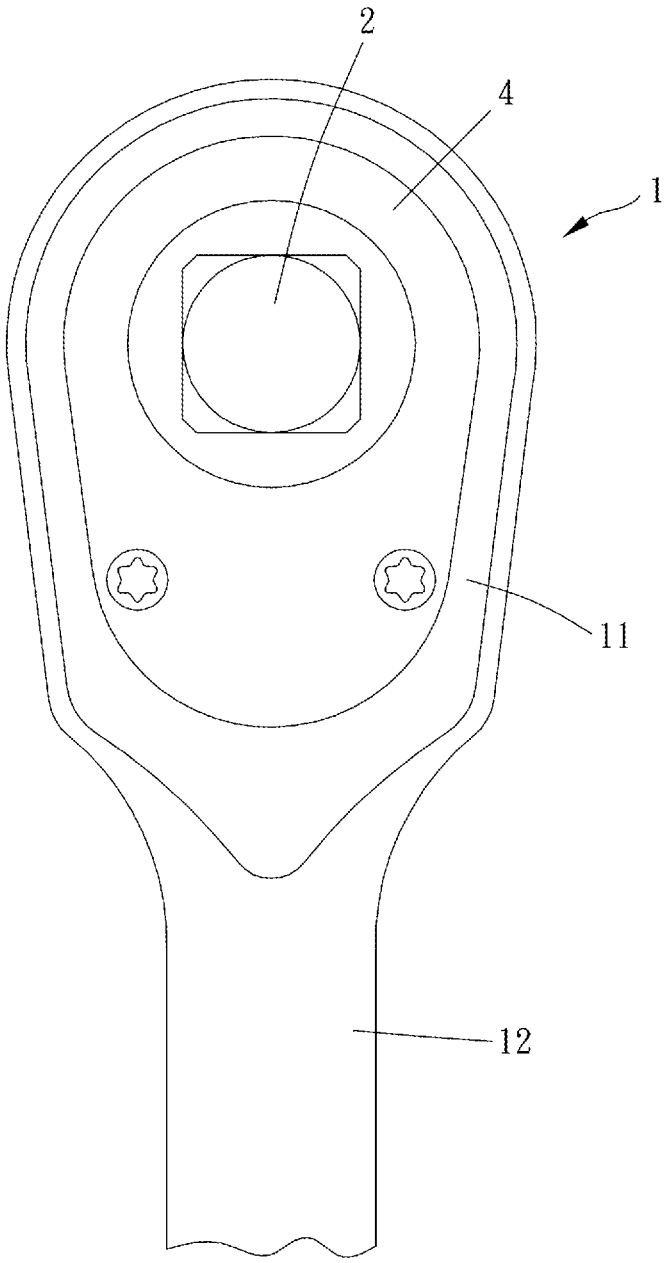
FIG. 1 is a schematic diagram of a first preferable embodiment of the present invention.
Figure 2:
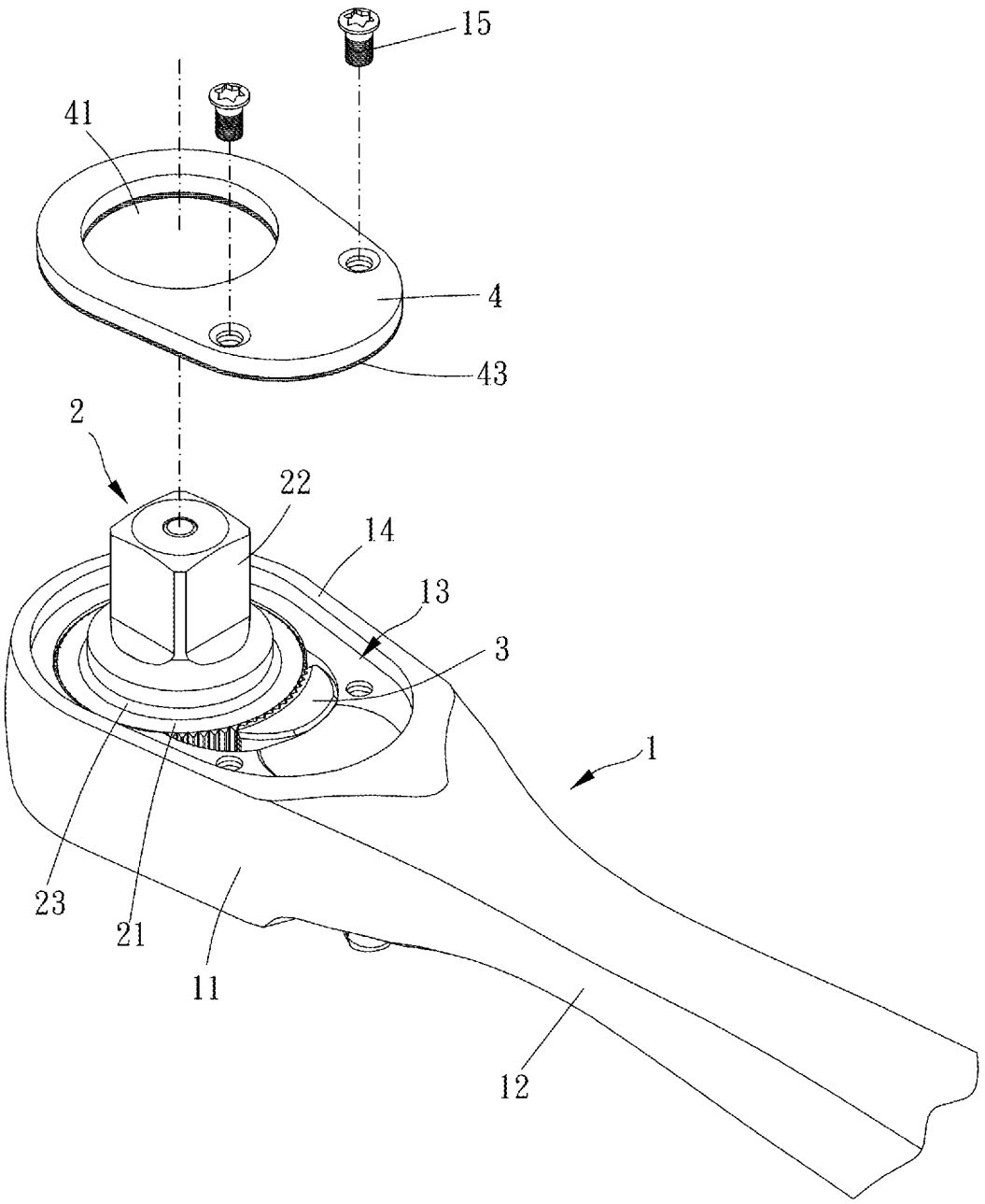
FIG. 2 is a breakdown drawing of the first preferable embodiment of the present invention.
Figure 3:
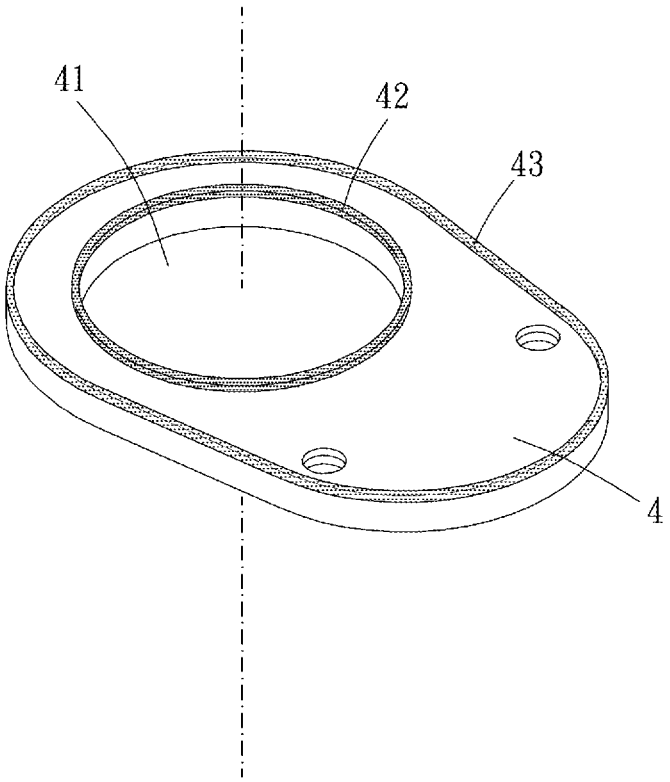
FIG. 3 is a partial stereogram of the first preferable embodiment of the present invention.
Figure 4:
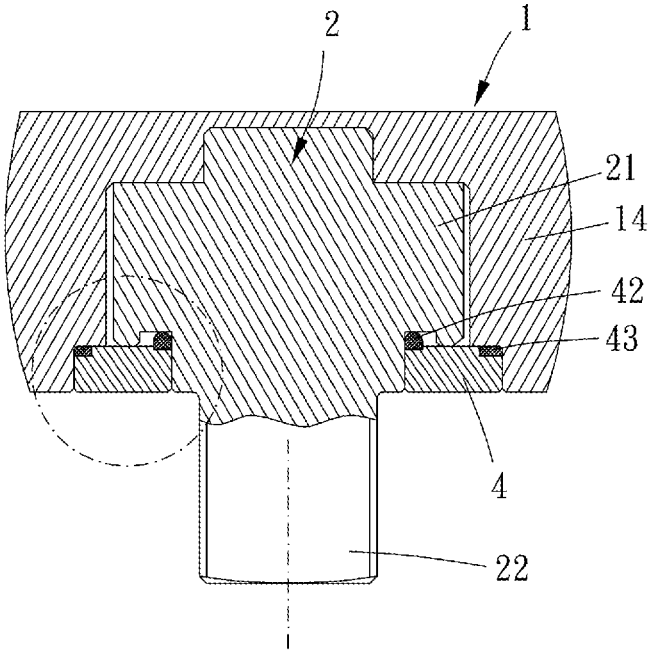
FIG. 4 is a cross-sectional view of the first preferable embodiment of the present invention.
Figure 5:
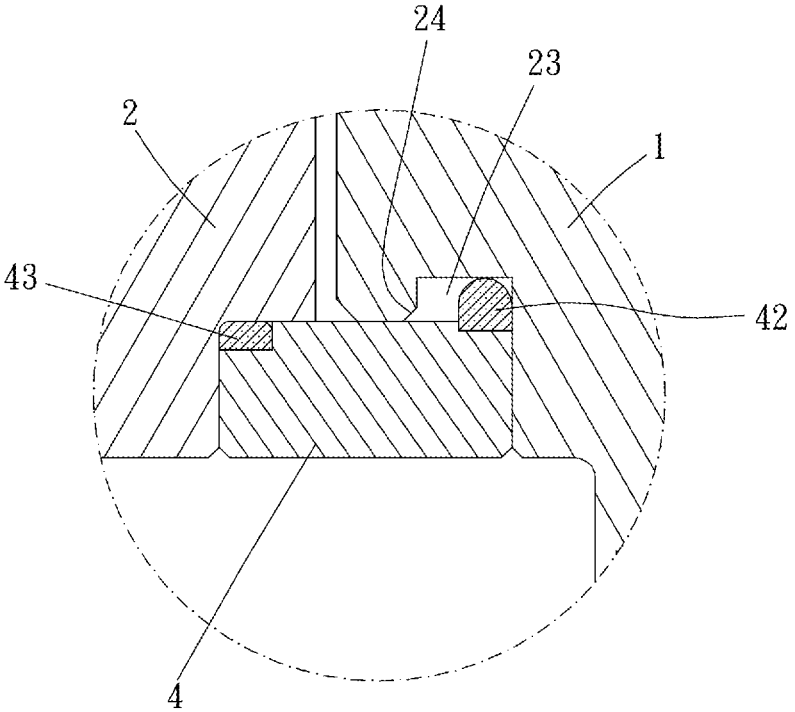
FIG. 5 is an enlargement of FIG. 4.
Figure 6:
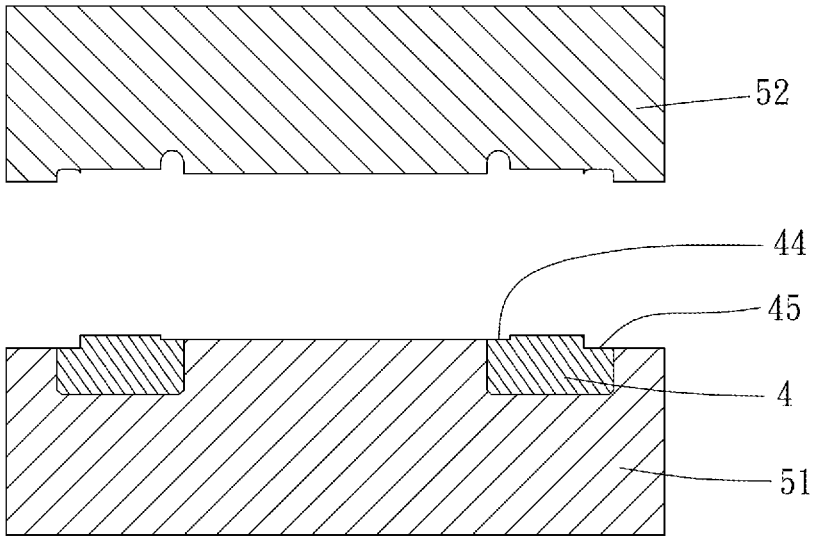
FIGS. 6 and 7 are schematic diagrams showing manufacturing processes of a covering member according to the first preferable embodiment of the present invention.
Figure 7:
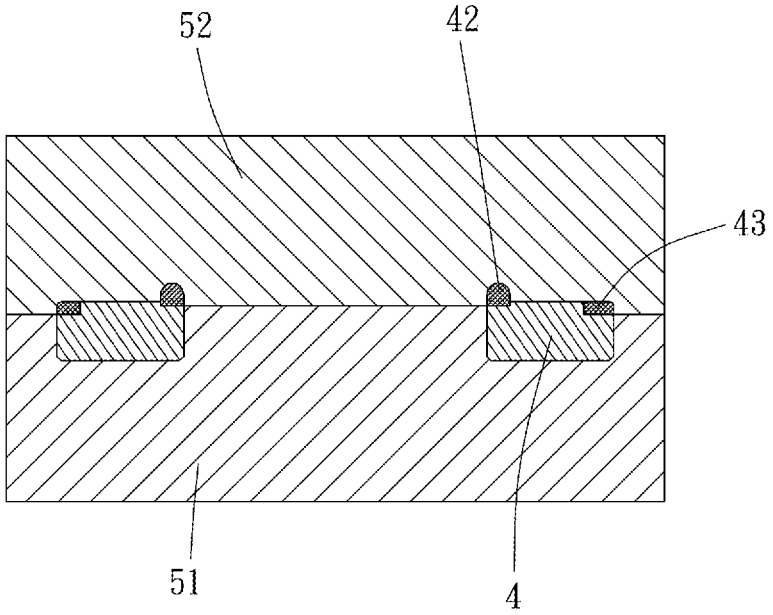

Please refer to FIGS. 1 to 7 for a preferable embodiment of the present invention. A wrench of the present invention includes a main body 1 and a covering member 4.

The main body 1 includes a head portion 11 and a handle 12, and the head portion 11 has a receiving groove 13. The receiving groove 13 has a driving member 2 and a restriction member 3 disposed therewithin, and the restriction member 3 is abutted against the driving member 2 and the driving member 2 is rotatable relative to the head portion 11. In this embodiment, the wrench is a ratchet wrench, and the driving member 2 includes a ratchet wheel. In other embodiments, the wrench may be a torque wrench or other types of wrenches.

The covering member 4 covers the receiving groove 13 and includes a through hole 41. One of the main body 1 and the covering member 4 has a first washer 42 and a second washer 43 integrally disposed thereon, and the first washer 42 and the second washer 43 are abutted against and between the main body 1 and the covering member 4. In this embodiment, the first washer 42 and the second washer 43 are integrally formed on a side of the covering member 4 facing the receiving groove 13. Since the first washer 42 and the second washer 43 are integrally formed on the covering member 4, the first washer 42 and the second washer 43 are unmovable relative to the covering member 4 when the covering member 4 is assembling to the head portion 11 to cover the receiving groove 13. Therefore, the first washer 42 and the second washer 43 can effectively seal up gaps between the head portion 11 and the covering member 4, which prevents dust and impurities from entering the receiving groove 13. The wrench is durable to use and easy to assemble. In this embodiment, the covering member 4 is mounted to the head portion 11 by two fasteners 15. In other embodiments, the covering member may be directly engaged or in tight-fit with the head portion.

Specifically, the first washer 42 and the second washer 43 are integrally formed on the covering member 4 by transfer molding. The first washer 42 surrounds an edge around the through hole 41, and the second washer 43 surrounds an outer peripheral edge of the covering member 4. In this embodiment, the covering member 4 is made of metal (or hard plastic), which allows the first washer 42 and the second washer 43 which are made of plastic or rubber to be integrally formed on the covering member 4 by transfer molding. Therefore, the first washer 42 and the second washer 43 are not easy to slide relative to the covering member 4 when the covering member 4 is assembled to the main body 1. With transfer molding technology, shapes of the first washer 42 and the second washer 43 are designable to meet various structural requirements, and the first washer 42 and the second washer 43 can be formed on designated positions of the covering member 4, which allows diverse designs of the wrench.

Moreover, the first washer 42 is abutted against and between the driving member 2 and the covering member 4. The main body 1 includes an annular wall 14, and the annular wall 14 defines the receiving groove 13. The second washer 43 is abutted against and between the annular wall 14 and the covering member 4.

The driving member 2 includes a rotating portion 21 and a driving portion 22 connected with each other, and the driving portion 22 penetrates through the through hole 41. A side of the rotating portion 21 facing the covering member 4 has a first annular groove 23, and the first washer 42 is disposed within the first annular groove 23.

The present invention further provide a method for manufacturing the wrench as described above, including following steps of: preparing a main body 1 including a head portion 11 and a handle 12; forming a receiving groove 13 on a side of the head portion 11; rotatably assembling a driving member 2 within the receiving groove 13; assembling a restriction member 3 within the receiving groove 13 and abutting the restriction member 3 against the driving member 2; preparing a covering member 4; forming a through hole 41 on the covering member 4; integrally forming a first washer 42 and a second washer 43 on one of the main body 1 and the covering member 4 by transfer molding; covering the receiving groove 13 of the head portion 11 with the covering member 4; abutting the first washer 42 and the second washer 43 against and between the main body 1 and the covering member 4. In this embodiment, the first washer 42 and the second washer 43 are integrally formed on a side of the covering member 4 by transfer molding.

With the method as described above, the covering member 4 on which the first washer 42 and the second washer 43 are integrally formed is manufactured. The first washer 42 and the second washer 43 are not easy to move relative to the covering member 4 during assembling so that the first washer 42 and the second washer 43 can effectively seal up the gaps between the head portion 11 and the covering member 4, which prevents dust and impurities from entering the receiving groove 13. The wrench is durable to use. The method of the present invention allows a washer with a particular shape to be applied on a designated position of a hand tool, and the method also can be used to manufacture a washer fitting an inner structure of the hand tool, which provides good sealing effect and allows diverse designs of hand tools.

Specifically, the method further includes steps of: preparing a first mold 51 and a second mold 52; biasing the first mold 51 and the second mold 52 against the covering member 4; and injecting a raw material (such as melted rubber or plastic) between the first mold 51 and the second mold 52 to form the first washer 42 and the second washer 43 on a side of the covering member 4 by transfer molding. The first washer 42 and the second washer 43 can be formed on the covering member 4 in designated shapes according to mold cavities between the first mold 51 and the second mold 52. The first washer 42 and the second washer 43 respectively have a fixed shape and are deformed when urging by the covering member 4 and the main body 1 so as to provide preferable sealing effect. Shapes of the first washer 42 and the second washer 43 can be changed before curing according to shapes of the covering member 4 and the main body 1 so as to be suitable for the covering member 4 and the main body 1 with different specifications. Relative to a conventional assembling method, the first washer 42 and the second washer 43 of the present invention can be directly molded on the covering member 4 in designated shapes according shapes of the mold cavities between the first mold 51 and the second mold 52, which provides good sealing performance and allows the washers to be molded in designated positions.

Figure 8:
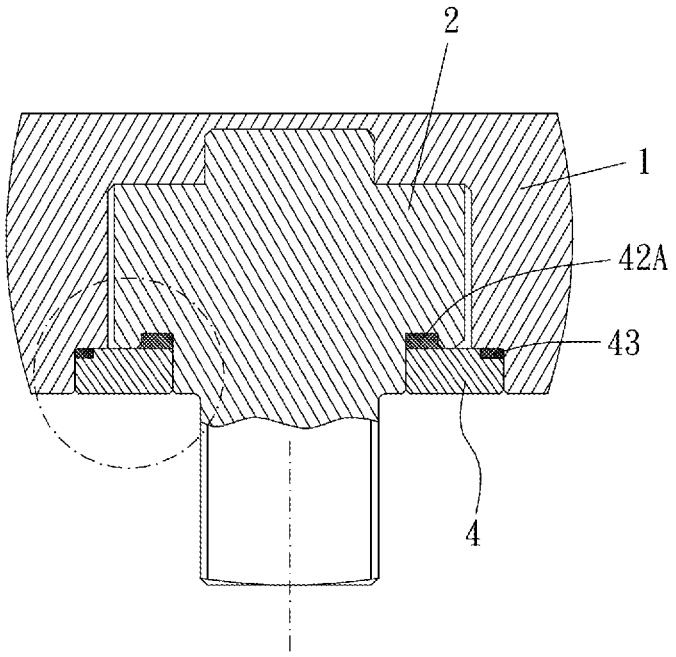
FIG. 8 is a cross-sectional view of a second preferable embodiment of the present invention.
Figure 9:
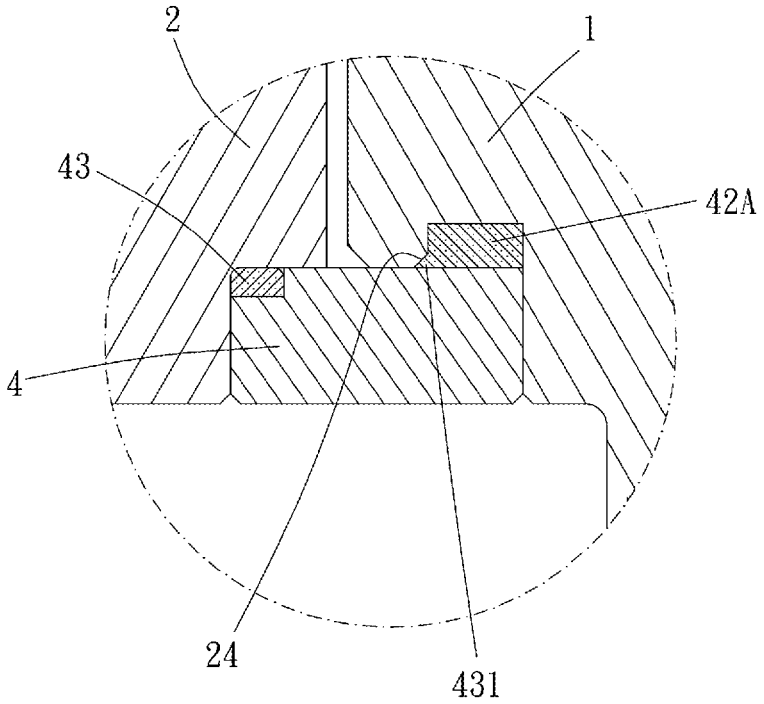
FIG. 9 is an enlargement of FIG. 8.

Please refer to FIGS. 8 and 9, showing a second embodiment of the present invention. The first annular groove 23 is adjacent to the driving portion 22, and a side of an outer groove wall of the first annular groove 23 close to the covering member 4 has a chamfer 24 disposed thereon. The first washer 42A has an extending segment 431 integrally disposed thereon, and the extending segment 431 protrudes into a notch between the chamfer 24 and the covering member 4 so as to provide good sealing effect and prevent dust and impurities from entering the notch.

Figure 10:
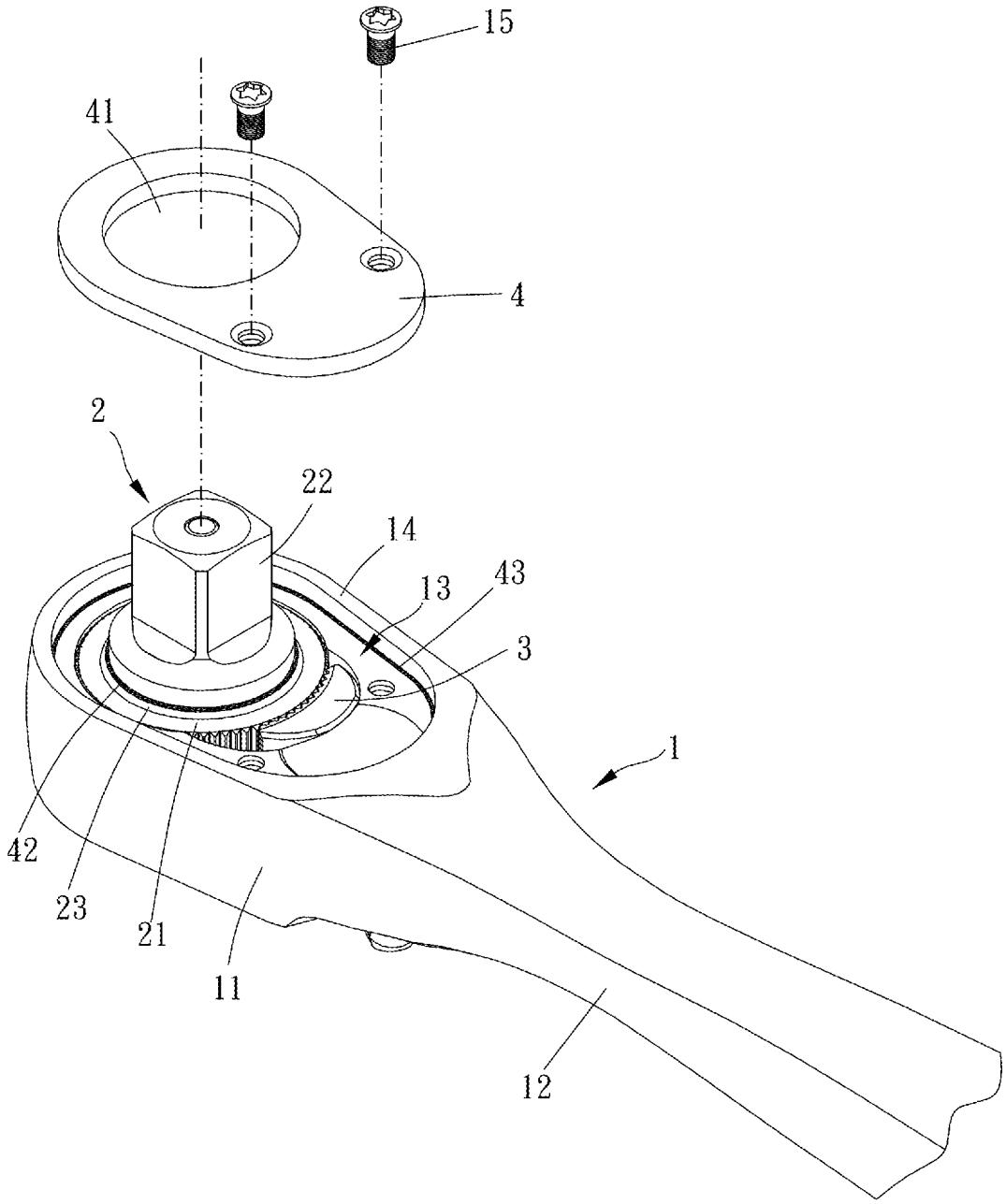
FIG. 10 is a breakdown drawing of a third preferable embodiment of the present invention.

Please refer to FIG. 10, showing a third embodiment of the present invention. The first washer 42 and the second washer 43 are additionally connected with the covering member 4, and the first washer 42 and the second washer 43 are integrally disposed on the main body 1. In this embodiment, the first washer 42 and the second washer 43 are integrally formed on the annular wall 14 and the first annular groove 23 by transfer molding, respectively, which also allows the first washer 42 and the second washer 43 to effectively seal up the gaps between the head portion 11 and the covering member 4.

Figure 11:
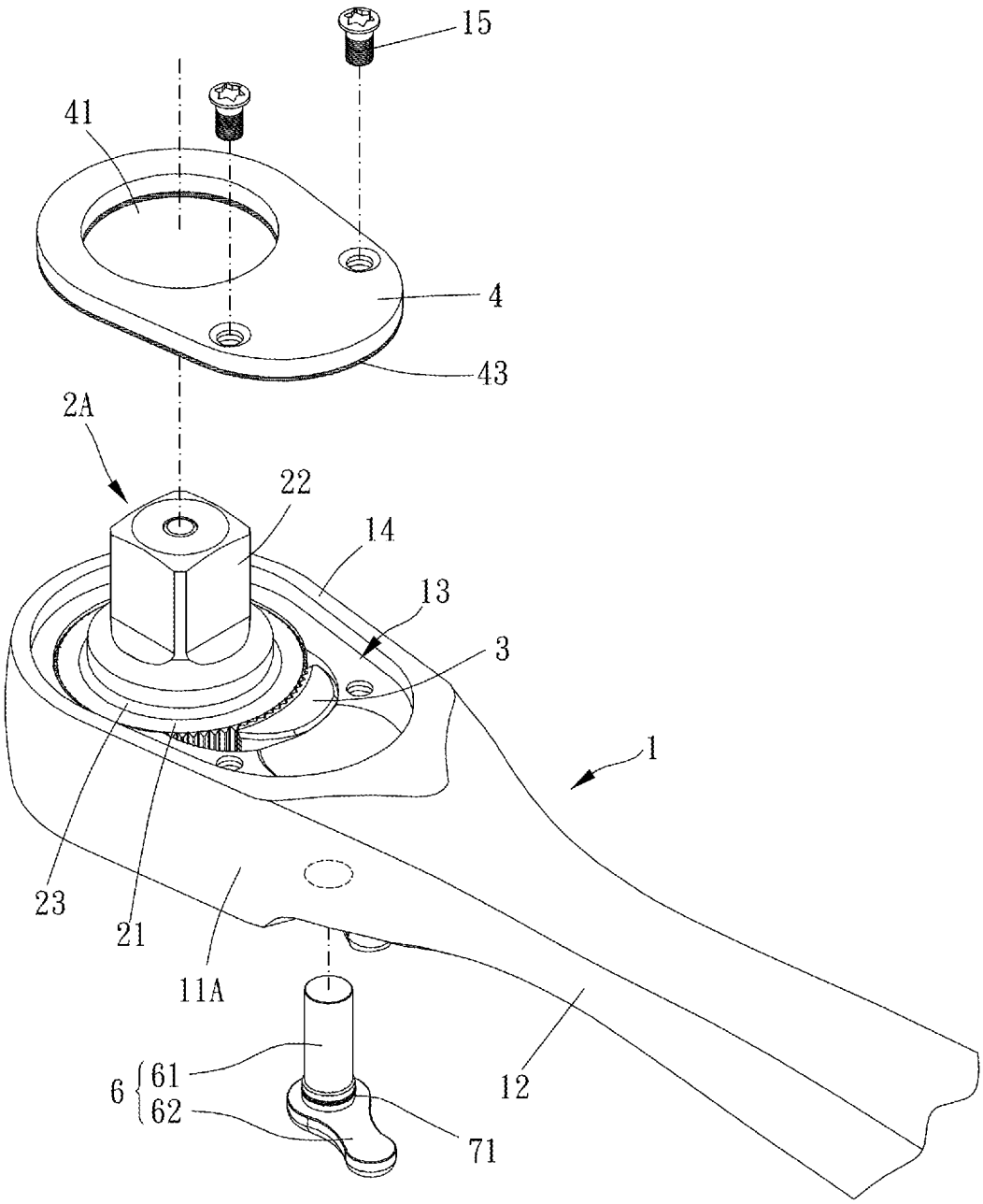
FIG. 11 is a breakdown drawing of a fourth preferable embodiment of the present invention.
Figure 12:
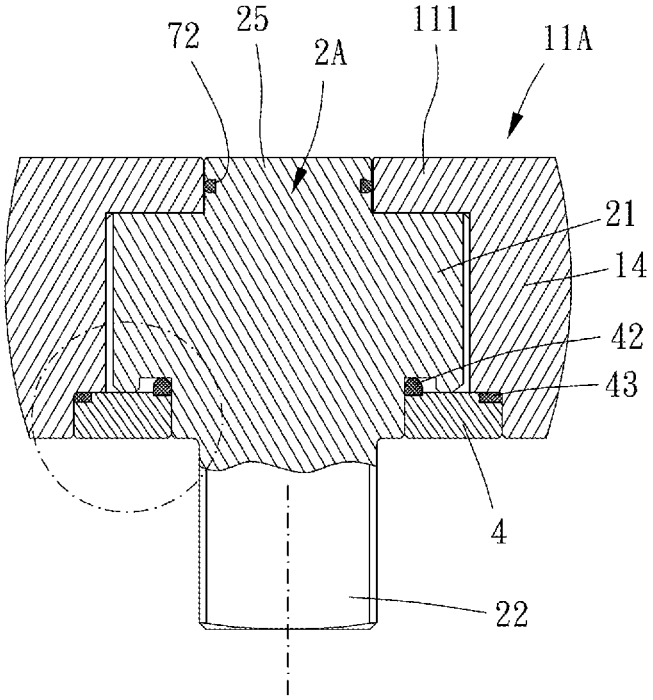
FIG. 12 is a cross-sectional view of the fourth preferable embodiment of the present invention.

Please refer to FIGS. 11 and 12, showing a fourth embodiment of the present invention. The control member 6 includes a switch member 61 and a lever 62, and the switch member 61 is rotatably disposed within the head portion 11A. The lever 62 transversely extends from an end of the switch member 61 remote from the head portion 11A. In this embodiment, the wrench is a ratchet wrench, and the lever 62 can be operated to drive the switch member 61 to rotate so as to adjust an idling direction of the ratchet wrench. A third washer 71 is integrally formed on an outer circumferential wall of the switch member 61 by transfer molding, and the third washer 71 is abutted against and between the switch member 61 and the head portion 11A so as to prevent dust and impurities from entering the head portion 11A.

Moreover, an end of the rotating portion 21 of the driving member 2A remote from the driving portion 22 has a pillar 25 protrudingly disposed thereon. The head portion 11A has a top plate 111, and the pillar 25 is rotatably disposed within the top plate 111. A fourth washer 72 is integrally formed on an outer circumferential wall of the pillar 25 by transfer molding, and the fourth washer 72 is abutted against and between the pillar 25 and the top plate 111 so as to prevent dust and impurities from entering the head portion 11A.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wrench, including:

a main body, including a head portion and a handle, the head portion having a receiving groove, the receiving groove having a driving member and a restriction member disposed therewithin, the restriction member being abutted against the driving member and the driving member being rotatable relative to the head portion; and a covering member, covering the receiving groove, including a through hole, one of the main body and the covering member having a first washer and a second washer integrally disposed thereon, the first washer and the second washer being abutted against and between the main body and the covering member;

wherein the first washer and the second washer are integrally formed on the covering member by transfer molding, the first washer surrounds an edge around the through hole, and the second washer surrounds an outer peripheral edge of the covering member;

wherein the driving member includes a rotating portion and a driving portion connected with each other, the driving portion penetrates through the through hole, a side of the rotating portion facing the covering member has a first annular groove, and the first washer is disposed within the first annular groove;

wherein the first annular groove is adjacent to the driving portion, a side of an outer groove wall of the first annular groove close to the covering member has a chamfer disposed thereon, the first washer has an extending segment integrally disposed thereon, and the extending segment protrudes into a notch between the chamfer and the covering member;

wherein the covering member is made of metal, and the first washer and the second washer are made of plastic or rubber; the first washer and the second washer are entirely received between the main body and the covering member when the covering member covers the receiving groove.

2. The wrench of claim 1, wherein the first washer and the second washer are integrally formed on a side of the covering member facing the receiving groove.

3. The wrench of claim 1, wherein the first washer is abutted against and between the driving member and the covering member, the main body further includes an annular wall, the annular wall defines the receiving groove, and the second washer is abutted against and between the annular wall and the covering member.

4. The wrench of claim 1, wherein the first washer is abutted against and between the driving member and the covering member, the main body further includes an annular wall, the annular wall defines the receiving groove, the second washer is abutted against and between the annular wall and the covering member; and the covering member is mounted to the head portion by two fasteners.

5. The wrench of claim 1, further including a control member, wherein the control member includes a switch member and a lever, the switch member is rotatably disposed within the head portion, the lever transversely extends from an end of the switch member remote from the head portion, a third washer is integrally formed on an outer circumferential wall of the switch member by transfer molding, and the third washer is abutted against and between the switch member and the head portion.

6. The wrench of claim 1, wherein an end of the rotating portion remote from the driving portion has a pillar protrudingly disposed thereon, the head portion has a top plate, the pillar is rotatably disposed within the top plate, a fourth washer is integrally formed on an outer circumferential wall of the pillar by transfer molding, and the fourth washer is abutted against and between the pillar and the top plate.

7. A method for manufacturing the wrench of claim 1, including following steps of:

preparing the main body including the head portion and the handle; forming the receiving groove on a side of the head portion; rotatably assembling the driving member within the receiving groove; assembling the restriction member within the receiving groove and abutting the restriction member against the driving member;

preparing the covering member; forming the through hole on the covering member; integrally forming the first washer and the second washer on one of the main body and the covering member by transfer molding; and covering the receiving groove of the head portion with the covering member; abutting the first washer and the second washer against and between the main body and the covering member.

8. The method of claim 7, further including steps of: preparing a first mold and a second mold; biasing the first mold and the second mold against the covering member; and injecting a raw material between the first mold and the second mold to form the first washer and the second washer on a side of the covering member by transfer molding.

* * * * *